United States Patent [19]

Bush

[11] 4,069,348

[45] Jan. 17, 1978

[54] PACKAGE AND METHOD OF FORMING THE SAME

[75] Inventor: Robert G. Bush, Green Bay, Wis.

[73] Assignee: L. D. Schreiber Cheese Company, Inc., Wis.

[21] Appl. No.: 730,924

[22] Filed: Oct. 8, 1976

Related U.S. Application Data

[63] Continuation of Ser. No. 499,788, Aug. 22, 1974, abandoned.

[51] Int. Cl.[2] ..... B65D 83/08; B65D 85/76

[52] U.S. Cl. ..... 426/119; 206/471; 206/526; 426/115; 426/396

[58] Field of Search ..... 426/108, 115, 119, 120, 426/121, 124, 129, 420, 410, 127, 132, 396, 414, 513, 518; 206/461–471, 498, 526, 536, 820; 229/43

[56] References Cited

U.S. PATENT DOCUMENTS

| | | | |
|---|---|---|---|
| 1,896,253 | 2/1933 | Smith | 206/820 X |
| 2,527,919 | 10/1950 | Drangle | 206/461 X |
| 2,555,033 | 5/1951 | Harris | 426/119 X |
| 2,635,965 | 4/1953 | Hensgen et al. | 426/420 X |
| 2,665,993 | 1/1954 | Swanson | 426/119 |
| 2,779,465 | 1/1957 | Anderson | 206/461 X |
| 3,051,584 | 8/1962 | Tindell | 426/119 X |
| 3,138,466 | 6/1964 | Long | 426/115 X |
| 3,145,112 | 8/1964 | Boegershausen | 426/121 |
| 3,192,091 | 6/1965 | Hey et al. | 206/461 |
| 3,236,369 | 2/1966 | Moore | 426/119 X |
| 3,292,810 | 12/1966 | Schechter | 426/119 X |
| 3,703,384 | 11/1972 | Seiferth et al. | 426/121 |
| 3,730,739 | 5/1973 | Seiferth et al. | 426/119 |
| 3,792,181 | 2/1974 | Mahaffy et al. | 426/129 X |
| 3,830,944 | 8/1974 | Dimitriadis et al. | 426/124 X |
| 3,836,679 | 9/1974 | Seiferth et al. | 426/129 X |

FOREIGN PATENT DOCUMENTS

| | | | |
|---|---|---|---|
| 543,711 | 7/1957 | Canada | 426/129 |
| 873,341 | 4/1953 | Netherlands | 206/820 |

*Primary Examiner*—William A. Cuchlinski, Jr.

[57] ABSTRACT

A sealed package is provided wherein a plurality of quantities of product in a stack, such as cheese slices, are hermetically sealed in individual compartments by interleaf sheets which are releasably sealed to a backing board. Interleaf sheets are positioned between the respective quantities of product in the stack and releasably sealed along the marginal edge portions of the interleaf sheets to a peripheral portion of the backing board, outwardly of the edges of the quantities of product which are thereby encapsulated. The interleaf sheets can be hermetically sealed directly, respectively to the backing board in a progressive, concentric manner, or to each other with the innermost sheet sealed to the backing board, to form progressive but coincident seals. The backing board can be flat, or cup-shaped with a flange to which the interleaf sheets are sealed. Correspondingly, the interleaf sheet may be appropriately preformed to provide flat faces and edges for sealing to each other and/or to the backing board, or they may be pieces of appropriately sealable sheet material of proper sizes. When a flat backing board is used, the product can be disposed on both sides of the backing board.

The package can be formed by various combinations of the steps of positioning a backing board which is adapted to receive a stack of quantities of product, placing a quantity of product on the backing board, positioning an interleaf sheet in face-to-face juxtaposition to the quantity of product such that the interleaf sheet extends beyond the edges of the quantity of product, and releasably sealing the interleaf sheet to the backing board outwardly of the edges of the quantity of product.

25 Claims, 9 Drawing Figures

PACKAGE AND METHOD OF FORMING THE SAME

This is a continuation of application Ser. No. 499,788, filed Aug. 22, 1974, now abandoned.

BACKGROUND OF THE INVENTION

Individually sealing quantities of a product in a package provides substantial advantages for packaging products that are sensitive to exposure to air. This is particularly advantageous for pre-sliced food products, such as cheese.

Known techniques for individually wrapping slices of a product are exemplified by U.S. Pat. No. 3,542,570 to Bush et al. and U.S. Pat. No. 3,162,539 to Repko. Packages of individually wrapped packages have enjoyed substantial market success due to their increased home shelf life, even in spite of the greater cost of such packaging. In the above-mentioned patents, each slice of product is dispensed in a wrapper which completely encloses the slice of product. When these wrapped slices are stacked to form a package of slices, at least two layers of wrapper are positioned between two adjacent slices of product, and the stack of individually wrapped slices are enclosed in still a further over-wrapper.

The type of wrapping material used in overwrapping such packages of cheese slices, for example, is an expensive laminated, coextruded or coated film including at least one layer of an oxygen impermeable material. It should be noted though that many individually wrapped cheese slices on the market today are hermetically sealed only by the overwrapper. The wrappers on the individual slices generally are not hermetically sealed. Thus, when the overwrapper is opened the slices tend to dry and to mold, although the process is significantly slowed by the individual wrappers.

Other prior art packaging systems utilize a continuous interleaf sheet which covers both faces of each slice of product in a stack and is alternately folded over one edge of each slice. This is illustrated in U.S. Pat. No. 2,635,965 to Hensgen et al., U.S. Pat. No. Re. 26,493 to Stoker, and U.S. Pat. No. 3,051,584 to Tindall. These patents show a single layer of wrapping material between adjacent food slices which facilitates separation of the slices and uses less interleaf film than individually wrapped slices but each slice of product is not individually sealed. Another prior art patent that also shows the use of an interleaf sheet between adjacent slices of product is Seifert et al. U.S. Pat. No. 3,730,739. The Seifert patent uses separate interleaf sheets to aid in dispensing the product, but, again, has the disadvantage that individual slices of product are not separately sealed.

Using a somewhat related approach to the individual wrapping system, Edwards U.S. Pat. No. 3,325,000 discloses a package for cigars wherein each cigar is in an individual compartment defined by a supporting tray that borders each article on both ends and three sides, and a cover sheet which can be removed to expose an individual cigar. This configuration has numerous disadvantages including not reducing the package size as each article is dispensed. Additionally, it is less economical to have a rigid supporting tray bordering each article on three sides. In another embodiment in the Edwards patent, each article is individually sealed by a tray that borders the article on both ends and three sides, and is releasably frictionally secured to one wall of an adjacent tray. This embodiment also has the disadvantages that each severable tray seals a single cigar, rather than forming an additional seal around all remaining cigars, and is less economical since it requires each article to be enclosed in a rigid tray.

SUMMARY OF THE INVENTION

By the present invention all of the foregoing problems are overcome and there is provided an economical package requiring no overwrapper, and in which each separate quantity of product such as a cheese or luncheon meat slice is hermetically sealed while using a single interleaf sheet between individual quantities of product. Moreover when an individual quantity of product is removed, all others remain hermetically sealed. And in selected embodiments of the invention the package becomes smaller and less space consuming as the individual quantities are removed.

In accordance with the present invention, a plurality of quantities of product, such as cheese slices, may be hermetically sealed in individual compartments by interleaf sheets which are releasably sealed to a backing board, and each quantity of product may be sealed to the backing board independently of all other quantities of product.

In one embodiment of this invention, the backing board is oxygen impermeable, or provided with an oxygen impermeable layer and has a first piece of product adjacent to a central portion of the backing board. A first interleaf sheet is releasably sealed to the backing board along a marginal portion of the interleaf sheet and outwardly of the edges of the first quantity of product. Each of the remaining interleaf sheets are releasably sealed along a marginal portion thereof to the adjacent interleaf sheet. The outermost sheet may be of heavier gauge, tougher or stronger material then the other interleaf sheet if desired to provide greater handling and shipping abrasion, wear and puncture resistance. In producing this package, the seals may be formed simultaneously or individually, such as by a heated sealing bar or form pressed into engagement with the outermost interleaf sheet; and the space about each product slice may be evacuated and/or flushed with a preservative gas.

In another embodiment of this invention, a first interleaf sheet is sealed along a marginal portion to an oxygen impermeable backing board, thereby encapsulating a first quantity of product. Each of the remaining interleaf sheets is releasably sealed along a marginal portion directly to the backing board outwardly of the seal formed by interleaf sheets disposed closer to the backing board and inwardly of the seal formed by the interleaf sheets disposed further from the backing board. Here also the outermost sheet may differ from the others for the purposes stated above and the space about the individual quantities of product may be evacuated and/or flushed with a preservative gas.

Both of these embodiments for sealing the interleaf sheets can be utilized with backing boards having various configurations. Where a substantially flat backing board is used, quantities of product can be releasably sealed on both faces of the backing board. Both sealing embodiments may also be employed with a cup-shaped backing board having a flange, wherein the backing board has side walls surrounding the stack of product, and a free edge which is folded over to form a continuous flange which protrudes outwardly. The quantities of product and interleaf sheets are alternately arranged in the cup-shaped backing board and the interleaf sheets are releasably sealed to the backing board along the flange. In this arrangement the interleaf sheets may be preformed cups of increasing, or decreasing depth (depending upon the desired order of placement), or they may be flat sheets of flexible material.

There are several methods by which the sealed packages with the individually hermetically sealed compartments may be formed. The steps of positioning a backing board which is adapted to receive a stack of quantities of product, placing a quantity of product on the backing board, positioning an interleaf sheet in face-to-face juxtaposition to the quantity of product such that the interleaf sheet extends beyond the edges of the quantity of product, and releasably sealing the interleaf sheet to the backing board outwardly of the edges of the piece of product, can be performed in various combinations and orders to form packages embodying this invention.

The present invention eliminates the need for an overwrap or heavy outer sheet to enclose a stack or plurality of individual slices into a package because each interleaf sheet functions as an overwrap with respect to the portion of the package disposed closer to the backing board. Each interleaf sheet forms a seal around the remaining portion of the package by being sealed to the backing board directly (or indirectly by being sealed to an adjacent interleaf sheet disposed closer to the backing board, with the interleaf sheet closest to the backing board being sealed directly to the backing board).

Another feature of the invention is a reduction in the amount of interleaf sheet material which is needed to individually wrap each quantity of product. Whereas in the prior art a product is individually wrapped by completely enclosing each quantity of product on both faces so that two separate layers of interleaf sheet material are positioned between adjacent quantities of product, the present invention seals quantities of product in individual compartments by placing only a single interleaf sheet between respective quantities of product. Instead of individually wrapping each quantity of product by having a single wrapper enclosing it on all sides, the present invention utilizes each interleaf sheet to function as part of the wrapper for two adjacent quantities of product, between which the interleaf sheet is disposed. Each interleaf sheet is releasably sealed to the backing board, thereby encapsulating an adjacent quantity of product between the interleaf sheet and another interleaf sheet disposed on the opposite side of the quantity of product.

Another feature is the protection from exposure to oxygen that is provided to the remaining portions of the package as each quantity of product is dispensed, due to the package construction wherein each interleaf sheet is sealed to the backing board and protects each quantity of product disposed between the interleaf sheet and the backing board.

DESCRIPTION OF THE PREFERRED EMBODIMENTS

Figure 1:
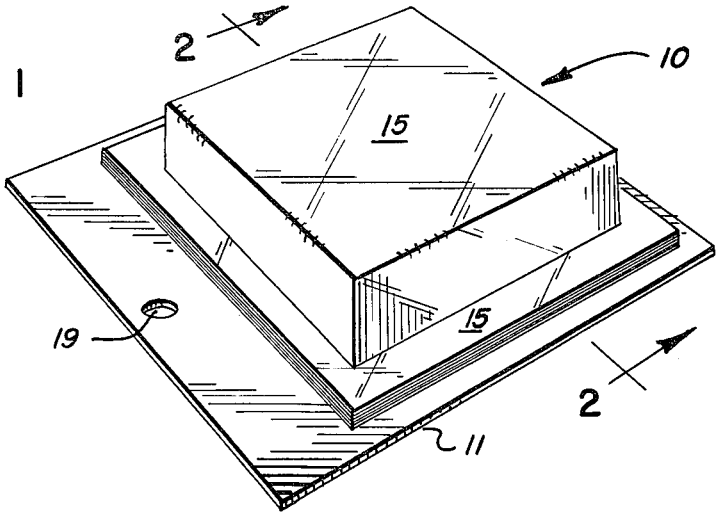
FIG. 1 is a perspective view of a sealed package embodiment of this invention.
Figure 2:
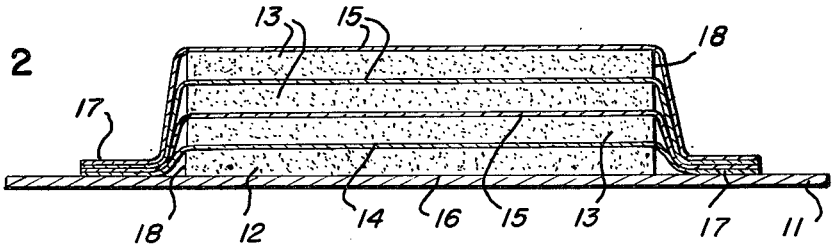
FIG. 2 is a cross-sectional view taken along plane 2—2 in FIG. 1.

Specifically referring to the drawings, FIGS. 1 and 2 show a package 10, which includes a substantially flat, oxygen impermeable backing board 11, quantities of product such as slices of cheese 12 and 13, and interleaf sheets 14 and 15. For convenience, the quantities of product will hereinafter be referred to as cheese slices, although it is recognized that other products, both sliced and in other shapes, advantageously may be packaged according to the principles of this invention.

The package 10 of FIGS. 1 and 2 has a first slice 12 positioned closest to the backing board 11 and has face 16 in face-to-face juxtaposition to backing board 11. Slices 13 are disposed in a stacked relation to slice 12, and have at least one interleaf sheet disposed between them, respectively at each interface. The first interleaf sheet 14 is the interleaf sheet closest to backing board 11, and is disposed between first slice 12 and adjacent slice 13 and the remaining interleaf sheets 15 are disposed respectively between the remaining slices 13 further from the backing board 11.

Interleaf sheets 14 and 15 have marginal portions 17 which extend beyond the edges 18 of slices 12 and 13. The first interleaf sheet 14 is releasably sealed along marginal portion 17 directly to backing board 11, outwardly of edges 18 of first slice 12 and each interleaf sheet 15 is releasably sealed along its marginal portion 17 to the inner-adjacent interleaf sheet with all of the seals between interleaf sheets positioned outwardly of, and extending continuously around, the edges of the quantities of product encapsulated between sealed pairs of interleaf sheets.

Thus, first slice 12 is encapsulated between backing board 11 and first interleaf sheet 14 which is releasably sealed to backing board 11. Slice 13, which is adjacent slice 12, is encapsulated between first interleaf sheet 14, and adjacent interleaf sheet 15 which is releasably sealed to interleaf sheet 14. Each slice 13 which is further removed from backing board 11 is sealed between a pair of interleaf sheets 15. As is shown in FIG. 2, the resulting configuration can have a single interleaf sheet disposed between adjacent slices, and the slices and interleaf sheets are disposed alternately in the stack. Any number of slices can be removed from the package by grasping a corresponding number of interleaf sheets and separating them from the package. The remaining quantities of product are residually contained in sealed compartments provided by the remaining interleaf sheets.

As indicated herein, the seals may be formed successively or concurrently. In addition, especially when they are formed successively, they may be of outwardly successively decreasing strength to facilitate easy removal of the outer sheet with a weaker seal without breaking the next inner stronger seal.

The backing board is preferably oxygen impermeable or so coated to obviate the need for positioning an oxygen impermeable interleaf sheet between the backing board and the first slice of product. Such a backing board may be formed of polyester, polyvinylchloride, a board having an oxygen impermeable coating, or other oxygen impermeable materials. If a backing board were to be used which was not oxygen impermeable, an oxygen impermeable interleaf sheet could be positioned between the first slice 12 of product and the backing board 11. By sealing this interleaf sheet to the backing board, the same result is achieved as if the backing board were oxygen impermeable.

Figure 5:
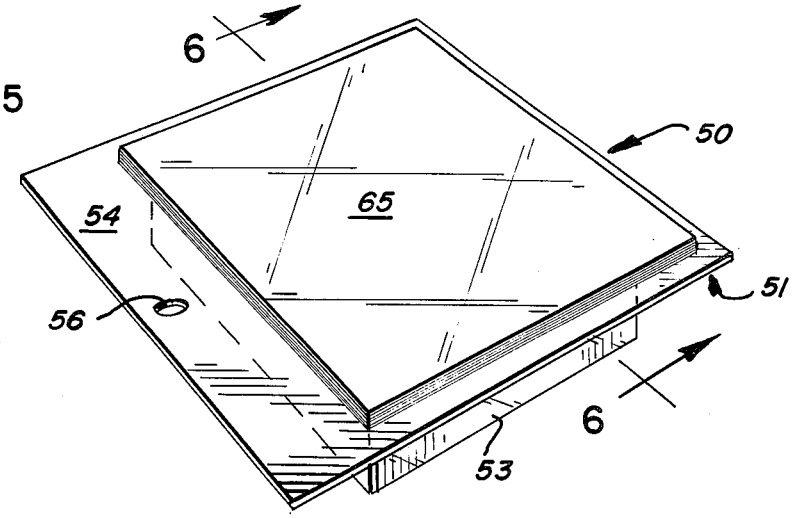
FIG. 5 is a perspective view of a sealed package in accordance with an alternate embodiment of the invention.

The backing board may have a shape corresponding to the shape of the food slices, and may have a marginal portion which extends beyond the seal between the interleaf sheets and the backing board. Inward of the edge and along the marginal portion of the backing board, a hole may be formed in the backing board to enable the package to hang from a rod or a rack. Holes 19 and 56 in the embodiments of FIGS. 1 and 5 illustrate this feature.

Where the interleaf sheets are thermo or vacuum preformed, they may be formed as a series of increasing or decreasing, as the case may be, series of nestable cups. The interleaf sheets are preferably oxygen impermeable and may be formed of any of a variety of materials having the appropriate physical characteristics. When oxygen impermeable films or materials are desired the same may be metal or appropriate plastic films that are laminated or coextruded with an oxygen barrier layer and a peelable-sealable coating. For example, if thermo or vacuum formed structures are desired, the same may be formed of a base substrate of nylon, polyethylene of various densities or a formable polyester or other similar coextrusion or laminate having an outer peelable heat sealable coating and a barrier layer either between the other two or on the opposite side of the thermo or vacuum formable structure. Where sheet material is desired for the formation of the interleaf sheets usable materials include, among other appropriate films, SARANEX (available from The Dow Chemical Company), saran, or polyester coated with a peelable coating or various other similar or appropriate coextrusions and laminates.

Figure 3:
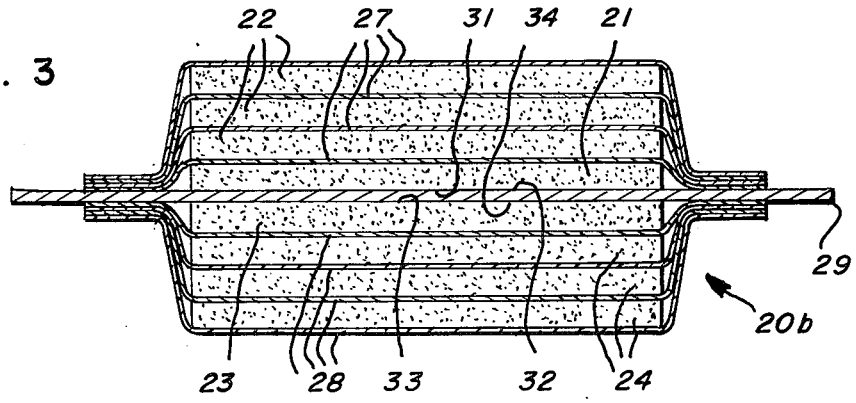
FIG. 3 is a cross-sectional view similar to FIG. 2 and illustrating another embodiment of the invention.

FIG. 3 illustrates another embodiment of the invention wherein the package has two stacks 20*a* and 20*b* of slices 21 and 22, and 23 and 24, respectively, of product and interleaf sheets 27 and 28 which are provided, and each stack is arranged as described in the embodiment shown in FIG. 2. A first stack of slices 21 and 22 is disposed on one side of a substantially flat backing board 29, such that face 31 of first slice 21 is in face-to-face juxtaposition to face 32 of backing board 29, and a second stack of slices is disposed on the opposite side of the backing board such that face 33 of first slice 23 is in face-to-face juxtaposition to face 34 of backing board 29. Each stack of slices is sealed to the backing board as described in the embodiment illustrated in FIG. 2.

Figure 4:
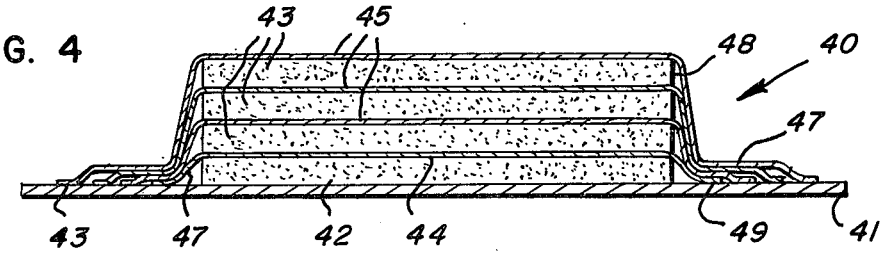
FIG. 4 is a cross-sectional view similar to FIG. 2 and illustrating another embodiment of the invention.

Another embodiment of a package which utilizes a substantially flat backing board is illustrated in FIG. 4. Package 40 is arranged similar to package 10 in FIGS. 1 and 2 but the interleaf sheets have a different marginal configuration and each interleaf sheet is sealed directly to the backing board. In this embodiment, interleaf sheets 45 are thermoformed or vacuum formed. First interleaf sheet 44 is the interleaf sheet closest to backing board 41, and has a marginal portion 47 which is releasably sealed directly to the backing board along 49, thereby encapsulating first slice 42 which is adjacent the backing board 41. Each of the remaining interleaf sheets 45 is also releasably sealed directly to backing board 41 along part 49 of the marginal portion 47 thereof, and the seal is positioned concentrically outwardly of the seal formed by the interleaf sheets disposed closer to backing board 41, and inwardly of the seal formed by the interleaf sheets 45 disposed further from backing board 41. The marginal portion 47 of each interleaf sheet is longer than the marginal portion of interleaf sheets disposed closer to the backing board 41, and shorter than the marginal portion 47 of interleaf sheets 45 disposed further from the backing board 41. Since the interleaf sheets are formed, a portion of each interleaf sheet adjacent to part 49 may be spaced apart from adjacent interleaf sheets.

Package 40 of FIG. 4 can have a configuration (not illustrated) that adapts the features of FIG. 3 wherein there are two stacks of slices of product, one stack being disposed on one side of the backing board, and the second stack being disposed on the opposite side of the backing board.

Figure 8:
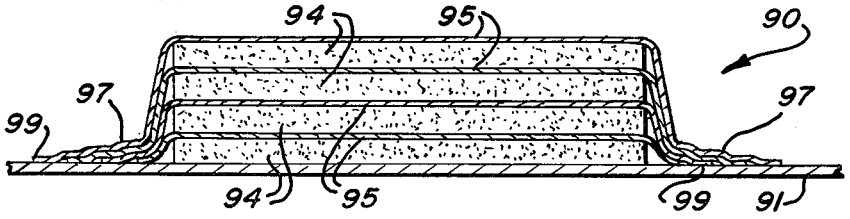
FIG. 8 is a cross-sectional view similar to FIG. 4 and illustrating an alternate embodiment of the invention.

Package 90 in FIG. 8 is arranged similar to package 40 in FIG. 4. Interleaf sheets 95 are formed of a flexible sheet material of the above-described type and qualities and have a marginal portion 97 which has a part 99 that is sealed directly to backing board 91, thereby encapsulating slices 94.

Figure 6:
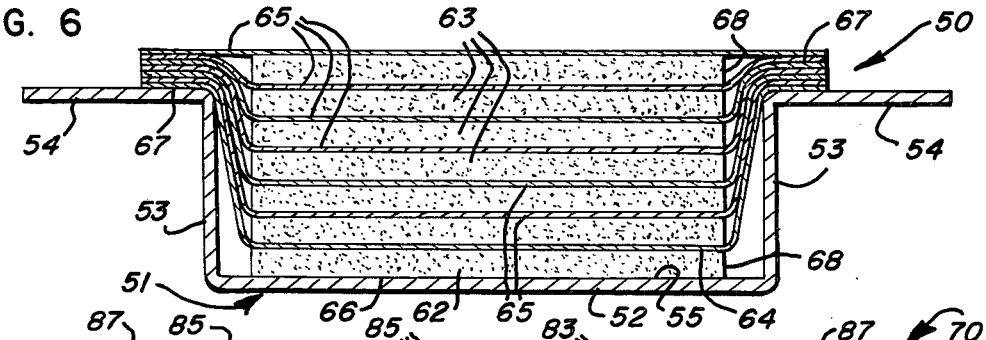
FIG. 6 is a cross-sectional view taken along plane 6—6 in FIG. 5.

FIGS. 5 and 6 illustrate another embodiment of this invention wherein package 50 has a cup-shaped oxygen impermeable backing board 51 having a bottom wall 52, and a side wall 53 which has a free end 54 that is folded over and forms a flange which protrudes outwardly from the unfolded portion of side wall 53 and is generally perpendicular thereto. A plurality of slices of product 62 and 63 are positioned in stacked relation to the bottom wall 52 of backing board 51. Bottom wall 52 is therefore slightly larger in area than slices 62 and 63. First slice 62 is the slice of product closest to the bottom wall 52 of backing board 51, and has face 66 in face-to-face juxtaposition to face 55 of bottom wall 52. First interleaf sheet 64 is adjacent first slice 62, is disposed between first slice 62 and adjacent slice 63, and is releasably sealed along marginal portion 67 directly to the flange portion 54 of backing board 51, outwardly of the edges 68 of first slice 62. As described for the embodiment in FIG. 2, each interleaf sheet 65 is releasably sealed along marginal portion 67 to an adjacent interleaf sheet which is disposed between interleaf sheet 65 and the backing board 51. Side wall 53 of backing board 51 surrounds the edges 68 of some, or all, of slices 62 and 63. Edges 68 of slices 62 and 63 do not directly contact side wall 53 because a narrow space is provided for the thickness of marginal portion 67 of the interleaf sheets 64 and 65. Due to the thickness of slices 62 and 63, interleaf sheets further removed from backing board 51 can have a shorter marginal area 67 than interleaf sheets closer to the backing board, where flange 54 is substantially parallel to bottom wall 52. If it is desired to utilize interleaf sheets of a substantially equal surface area, then flange 54 can be folded over further such that it forms an acute angle with side wall 53. It is recognized that flange 54 can be omitted, and the interleaf sheets can be sealed to either the outside or the inside surface of side wall 53.

Figure 7:
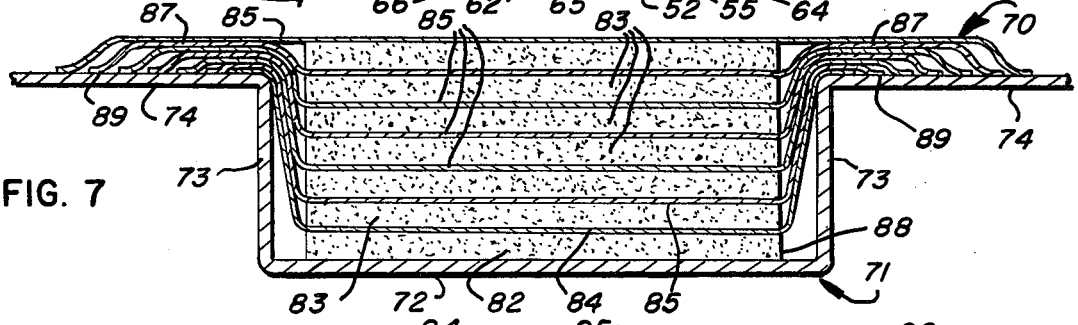
FIG. 7 is a cross-sectional view similar to FIG. 6 and illustrating an alternate embodiment of the invention.

The embodiment illustrated in FIG. 7 combines the features of the cup-shaped backing board in package 50 in FIG. 6 and having each interleaf sheet sealed directly to the backing board as is described for package 40 in FIG. 4. As in FIG. 4, interleaf sheets 85 are vacuum or thermoformed, and first interleaf sheet 84 may also be preformed. Backing board 71 has bottom wall 72 and side wall 73 which has a free end 74 that forms a flange which protrudes outwardly from the unfolded portion of side wall 73 and is generally perpendicular thereto. A plurality of slices of product 82 and 83 are positioned in stacked relation to bottom wall 72 of backing board 71. First interleaf sheet 84 is disposed between first slice 82 and adjacent slice 83, and is releasably sealed along part 89 of marginal portion 87 directly to the flange portion 74 of backing board 71 outwardly of the edges 88 of first slice 82. The interleaf sheets 85 are releasably sealed directly to backing board 71 along part 89 of the marginal portion 87 of each interleaf sheet, and each seal is positioned outwardly of the seal formed by the interleaf sheets disposed closer to backing board 71, and inwardly of the seal formed by the interleaf sheets 85 disposed further from backing board 71. Since the interleaf sheets are formed, a portion of each adjacent to part 89 may be spaced apart from adjacent interleaf sheets.

As illustrated in FIG. 6, the interleaf sheet 65 which is furthest removed from the backing board 51 may be flat and have marginal portions 67 in the same plane as the central portion of the interleaf sheet. Similarly, interleaf sheet 85 in FIG. 7 may have its central portion and a portion of the marginal portion adjacent the central portion in a planar configuration, and only a portion of the marginal portion adjacent part 89 curved to enable part 89 to be sealed to the backing board 72.

Figure 9:
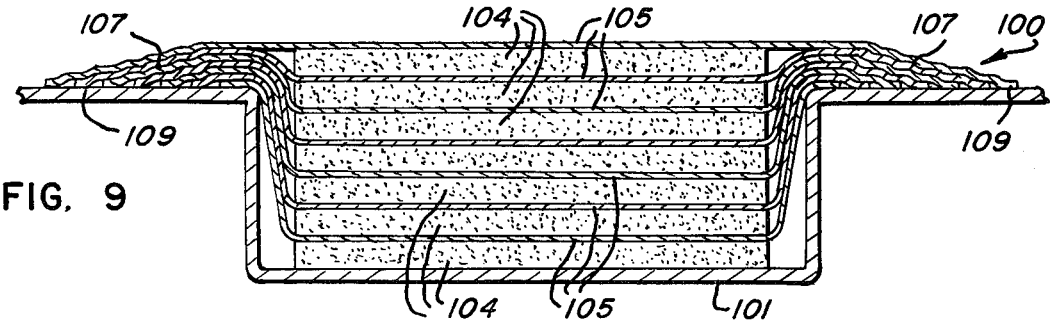
FIG. 9 is a cross-sectional view similar to FIG. 7 but illustrating yet another embodiment of the invention.

Package 100 in FIG. 9 is arranged similar to package 70 in FIG. 7. Interleaf sheets 105 are formed of a flexible sheet material as described above and have a marginal portion 107 which has a part 109 that is sealed directly to backing board 101, thereby encapsulating slices 104. Since the interleaf sheets 105 are a non-thermoformed film, the marginal portion 107 of each sheet may be juxtaposed to adjacent interleaf sheets and in contact therewith.

Unless protective measures are taken, the package will have a residual oxygen content in the space between adjacent interleaf sheets. A preservative atmosphere can be used to reduce the residual oxygen content to a level which is substantially below the oxygen content in the outside environment. Several means by which the residual oxygen content can be reduced include the use of carbon dioxide gas flushing, nitrogen and carbon dioxide blend gas flushing, and vacuumizing, or combinations thereof such as vacuumizing, breaking back with a preservative gas and then sealing.

In all of the above-described embodiments, the first slice of product is enclosed by the backing board and a single interleaf sheet, and every other slice is enclosed between two interleaf sheets. With the exception of the interleaf sheet furthest removed from the backing board, each interleaf sheet partially encloses (and separates) two adjacent slices of product. Both faces of each interleaf sheet are utilized in sealing the slices of product. Consequently, a cross-section of the package reveals that a single interleaf sheet is disposed between adjacent slices of product, as illustrated in FIGS. 2, 3, 4, 6 and 7. A sealed package of individually hermetically sealed compartments thus can be formed wherein the quantity of interleaf sheet material needed to individually seal each slice only slightly exceeds the surface area of the slices which it is desired to seal. This provides substantial savings in material over prior packages wherein the quantity of interleaf sheet material needed to individually seal each slice of product exceeds twice the surface area of the slices to be sealed. The package of this invention also has the advantage of reducing in volume as the product is dispensed, particularly in the embodiments of FIGS. 2, 3 and 4. An additional feature of this invention is that each interleaf sheet forms a seal around the entire portion of the package disposed between the interleaf sheet and the backing board, thereby providing additional protection to the remaining slices of product, particularly in the embodiments of FIGS. 4 and 6.

The sealed packages of this invention, with the individually hermetically sealed compartments, may be formed by several methods. The steps of (a) positioning a backing board which is adapted to receive a stack of quantities of product, (b) placing a quantity of product on the backing board, (c) positioning an interleaf sheet in face-to-face juxtaposition to the quantity of product such that the interleaf sheet extends beyond the edges of the quantity of product, (d) releasably sealing the interleaf sheet to the backing board outwardly of the edges of the piece of product, and (e) repeating steps (b), (c) and (d), can be performed in various combinations or in inverse order whereby the backing sheet is positioned last and all seals are formed simultaneously to form the package of this invention.

Each interleaf sheet can be sealed directly to the backing board, with the first interleaf sheet releasably sealed directly to the backing board, and the remaining interleaf sheets being releasably sealed directly to the backing board outwardly of the seal formed by interleaf sheets disposed closer to the backing board, and inwardly of the seal formed by interleaf sheets disposed further from the backing board; or the first interleaf sheet can be releasably sealed directly to the backing board, with each remaining interleaf sheet being releasably sealed to an adjacent interleaf sheet disposed between the remaining interleaf sheet and the backing board.

It should be noted that the drawings of this application are not to scale, and that the thickness of the film and of the backing board have been greatly increased to facilitate an understanding of the structure. Illustratively, the packaging film would be around 1–2 mils thick, while the backing board would have a thickness of around 5–10 mils. A cheese slice has a thickness in the range of 60–65 mils.

While this invention is susceptible of embodiment in many different forms, there is shown in the drawings and described herein in detail preferred embodiments of the invention, with the understanding that the present disclosure is to be considered as an exemplification of the principles of the invention and is not intended to limit the invention to the embodiments illustrated. In this regard, it should be noted that while it is presently contemplated that the invention disclosed herein has primary utility in the packaging of food products, it is also contemplated that the invention is applicable to the packaging of non-food products such as drugs and/or cosmetics, surgical and sterile items (syringes, swabs, sutures, etc.), moist towelettes, hardware, and other miscellaneous objects. In such a case it may not be necessary to use a hermetically sealed package or a preservative gas, and the package may include a pressure sensitive peelable seal.

What is claimed is:

1. A sealed package of individually sealed compartments comprising: a backing board, a stack of a plurality of quantities of product, a plurality of interleaf sheets of a material substantially impermeable to oxygen, at least one of said sheets being positioned between respective adjacent quantities of product in said stack, so that said quantities of product and said sheets are disposed alternately in said stack, said interleaf sheets being secured to said backing board by a manually releasable seal that extends completely around the periphery thereof to enclose each product quantity in a sealed substantially oxygen free compartment, said seal being sufficiently strong that said product can be dispensed by manually rupturing the releasable seal and removing a number of interleaf sheets corresponding to the desired number of quantities of product, while the remaining quantities of product are residually contained in sealed compartments provided by the remaining sealed interleaf sheets.

2. A package as described in claim 1 wherein two stacks of quantities of product and interleaf sheets are provided and arranged as set forth in claim 1, the stacks being disposed with one thereof on one side of said backing board and the other thereof on the opposite side of said backing board.

3. A package as described in claim 1 wherein said stack has a first quantity of product adjacent to said backing board, an interleaf sheet adjacent said first quantity of product is releasably sealed to said backing board along a marginal portion of said interleaf sheet, and each remaining interleaf sheet is releasably sealed to an adjacent interleaf sheet which is disposed between said remaining interleaf sheet and said backing board, each of said seals between the interleaf sheets being disposed outwardly of the edges of the quantity of product disposed between the sealed pair of interleaf sheets.

4. A package as described in claim 1 wherein said stack has a first quantity of product which is releasably sealed to said backing board outwardly of the edges of said product by a first interleaf sheet, and the remaining interleaf sheets are releasably sealed along a marginal portion directly to said backing board outwardly of the seal formed by interleaf sheets disposed closer to said backing board, and inwardly of the seal formed by the interleaf sheets disposed further from said backing board.

5. A package as described in claim 4 wherein the interleaf sheet closest to said backing board has a greater releasable seal strength than the interleaf sheets further removed from said backing board, and every other interleaf sheet has a greater releasable seal strength than the interleaf sheets further removed from said backing board and less than the releasable seal strength of the interleaf sheets closer to said backing board.

6. A package as described in claim 1 wherein said backing board has a side wall surrounding said stack of product, said side wall has a free end which is formed as a flange that protrudes outwardly from the side wall, and said interleaf sheets are releasably sealed to said backing board on said flange.

7. A package as described in claim 6 wherein said stack of product has a first quantity adjacent to said backing board, the interleaf sheet adjacent said first quantity of product is releasably sealed to said backing board on said flange, and each remaining interleaf sheet is releasably sealed along said flange to the adjacent interleaf sheet disposed between said remaining interleaf sheet and said backing board, said interleaf sheets being releasably sealed along a marginal portion of said interleaf sheets.

8. A package as described in claim 6 wherein said stack of product has a first quantity adjacent to said backing board, the interleaf sheet adjacent said first quantity is releasably sealed to said backing board on said flange, and the remaining interleaf sheets are releasably sealed along a marginal portion directly to said backing board along said flange outwardly of the seal formed by interleaf sheets disposed closer to said backing board, and inwardly of the seal formed by interleaf sheets disposed further from said backing board.

9. A package as described in claim 1 wherein said quantities of product are food slices, and said interleaf sheets are in face-to-face juxtaposition to said food slices in said stack.

10. A package as described in claim 9 wherein said interleaf sheets are thermoformed and are comprised of a series of nestable cups.

11. A package as described in claim 9 wherein said package has a residual oxygen content in the space between adjacent interleaf sheets which is reduced by means of a preservative atmosphere to a level which is substantially below the oxygen content in the outside environment.

12. A package as described in claim 1 wherein said backing board is oxygen inpermeable.

13. A method of forming a hermetically sealed package of individually sealed compartments, which comprises: positioning a backing board which is adapted to receive a stack of a plurality of quantities of product, placing a quantity of product on said backing board, positioning a first interleaf sheet in face-to-face juxtaposition to said quantity of product such that said interleaf sheet extends beyond the edge of said quantity of product, securing said interleaf sheet to said backing board by a manually releasable seal that extends along a continuous seal outwardly of the edges of the quantity of product to thereby encapsulate said piece of product in a sealed substantially oxygen free compartment, and repeating the steps of placing a piece of product, positioning an interleaf sheet, and securing said interleaf sheet, until the package contains the desired amount of quantities of product encapsulated in substantially oxygen free compartments, said securing steps being performed by imparting sufficient strength to the seals that product may be dispensed by manually rupturing the releasable seals and removing a number of interleaf sheets corresponding to the desired number of quantities of product, while the remaining quantities of product are residually contained in sealed compartments provided by the remaining sealed interleaf sheets.

14. A method as described in claim 13 wherein said first interleaf sheet is sealed along a marginal portion of said interleaf sheet directly to said backing board, and each remaining interleaf sheet is releasably sealed to an adjacent interleaf sheet which is disposed between said remaining interleaf sheet and said backing board.

15. A method as described in claim 13 wherein said first interleaf sheet is sealed along a marginal portion of said interleaf sheet directly to said backing board, and the remaining interleaf sheets are releasably sealed along a marginal portion directly to said backing board outwardly of the seal formed by interleaf sheets disposed closer to said backing board, and inwardly of the seal formed by the interleaf sheets disposed further from said backing board.

16. A method as claimed in claim 13 wherein said quantities of product are slices of cheese, and said interleaf sheet is preformed.

17. A method of forming a hermetically sealed package of individually sealed compartments, which comprises: positioning a backing board which is adapted to receive a stack of a plurality of quantities of product, placing a quantity of product on said backing board, positioning a first interleaf sheet in face-to-face juxtaposition to said quantity of product such that said interleaf sheet extends beyond the edge of said quantity of product, repeating the steps of placing a quantity of product and positioning an interleaf sheet until the package contains the desired number of quantities of product, and collectively securing said interleaf sheets to said backing board by a manually releasable seal that extends along a continuous seal wherein said first interleaf sheet is sealed directly to said backing board, and each remaining interleaf sheet is releasably sealed to an adjacent interleaf sheet which is disposed between said remaining interleaf sheet and said backing board to thereby encapsulate each quantity of product in a substantially oxygen free compartment, said securing step being performed by imparting sufficient strength to the seal to permit said quantities of product to be dispensed by manually rupturing the releasable seal and removing a number of interleaf sheets corresponding to the desired number of quantities of product while the remaining quantities of product continue to be covered by the remaining interleaf sheets and retained in substantially oxygen free sealed compartments.

18. A method of forming a hermetically sealed package of individually sealed compartments, which comprises: positioning an interleaf sheet which is adapted to extend beyond the edge of a quantity of product, placing a quantity of product in face-to-face juxtaposition to said interleaf sheet, repeating the steps of positioning an interleaf sheet, and placing a quantity of product, until the package contains the desired amount of quantities of product, positioning a backing board parallel to said quantities of product and said interleaf sheets and in face-to-face juxtaposition to at least one quantity thereof, and collectively securing said interleaf sheets to said backing board by a manually releasable seal that extends along a continuous seal wherein said first interleaf sheet is sealed along a marginal portion of said interleaf sheet directly to said backing board, and each remaining interleaf sheet is releasably sealed to an adjacent interleaf sheet which is disposed between said remaining interleaf sheet and said backing board to thereby encapsulate each quantity of product in a substantially oxygen free compartment, said securing step being performed by imparting sufficient strength to the seal to permit said product to be dispensed by manually rupturing the releasable seal and removing a number of interleaf sheets corresponding to the desired number of quantities of product while the remaining quantities of product continues to be covered by the remaining interleaf sheets and retained in substantially oxygen free sealed compartments.

19. A sealed package of individually sealed compartments comprising: a stack of a plurality of product slices having opposing major faces, lying in planes parallel with one another and a plurality of oxygen-impermeable members, one of said members overlying each major face of each product slice so that said members and said product slices are disposed alternately in said stack, said members having a marginal portion which extends beyond the periphery of said slices, the marginal portions of said members lying in planes parallel to the planes of said major faces and said marginal portions being secured together by a manually releasable seal that extends completely around the periphery thereof to enclose each product slice in a sealed substantially oxygen free compartment, said seal being sufficiently strong that said product can be dispensed by manually rupturing the releasable seal and removing a number of members corresponding to the desired number of product slices, while the remaining product slices are residually contained in sealed compartments provided by the remaining members.

20. A package as described in claim 19 wherein said members comprise a first member which is a backing board underlying a stack of product slices, and a plurality of second members which have a lesser thickness than said backing board and are releasably sealed to said backing board.

21. A package as described in claim 19 wherein: said members comprise a first member which underlies said stack of product slices, and a plurality of second members which are releasably sealed to said first member; said stack has a first product slice adjacent to said first member; a second member adjacent said first product slice is releasably sealed to said first member along a marginal portion of said first and second members; and each remaining second member is releasably sealed to an adjacent second member which is disposed between said remaining second members and said first member; each of said seals between the second members being disposed outwardly of the edges of the product slice disposed between the sealed pair of second members.

22. A method of forming a hermetically sealed package of individually sealed compartments, which comprises: positioning a first oxygen-impermeable member which is adapted to receive a stack of a plurality of product slices, placing a first of a plurality of product slices on said first member, positioning a first of a plurality of second oxygen-impermeable members in face-to-face juxtaposition to said first product slice said first and second members having a marginal portion extending beyond the edge of said product slice, securing said second member to said first member by a manually releasable seal that extends along a continuous seal outwardly of the edges of said product slice to thereby encapsulate said product slice in a substantially oxygen free, compartment and repeating the steps of placing a further product slice, positioning a further second member, and securing said further second member to said first member until the package contains the desired amount of product slices encapsulated in substantially oxygen free compartments, said securing steps being performed by imparting sufficient strength to the seals that product may be dispensed by manually rupturing the releasable seals and removing a number of oxygen-impermeable members corresponding to the desired number of quantities of product slices, while the remaining quantities of product slices are residually contained in sealed compartments provided by the remaining sealed oxygen-impermeable members.

23. A method as described in claim 22 wherein the first of said second members is sealed along a marginal portion thereof directly to said first member, and each of said further second members is releasably sealed to an adjacent second member which is disposed between said further second member and said first member.

24. A method of forming a hermetically sealed package of individually sealed compartments, which comprises: positioning an oxygen-impermeable member having a marginal portion which is adapted to extend beyond the edge of a product slice, placing a product slice in face-to-face juxtaposition to said member, repeating the steps of positioning an oxygen-impermeable member and placing a product slice until the package contains the desired amount of product slices, positioning a further oxygen-impermeable member in face-to-face juxtaposition to the last of said product slices, and securing said members together collectively by a manually releasable seal that extends along a continuous seal wherein each member is sealed along a marginal portion thereof to an adjacent member to thereby encapsulate each product slice in a substantially oxygen free compartment, said securing step being performed by imparting sufficient strength to the seal to permit said product slices to be dispensed by manually rupturing the releasable seal and removing a number of members corresponding to the desired number of product slices while the remaining product slices continue to be covered by the remaining members and retained in substantially oxygen free sealed compartments.

25. A sealed package of individually sealed compartments comprising: a stack of a plurality of product slices naving opposing major faces; and a plurality of oxygen-impermeable members, one of said members overlying each major face of each product slice so that said members and said product slices are disposed alternately in said stack, said members having a marginal portion which extends beyond the periphery of said slices, the marginal protions of said members being secured together by a manually releasable seal that extends completely around the periphery thereof to enclose each product slice in a sealed substantially oxygen free compartment, said seal being sufficiently strong that said product can be dispensed by manually rupturing the releasable seal and removing a number of members corresponding to the desired number of product slices while the remaining product slices are residually contained in sealed substantially oxygen free compartments provided by the remaining sealed members; and wherein said members comprise a first member which is a backing board underlying the stack of product slices, and plurality of second members which have a lesser thickness than said backing board and are secured to said backing board by a manually releasable seal.

* * * * *